US005649482A

United States Patent [19]

Hummel et al.

[11] Patent Number: 5,649,482

[45] Date of Patent: Jul. 22, 1997

[54] APPARATUS AND PROCESS FOR THE PRINT-ON AND PRINT-OFF SETTING OF A BLANKET CYLINDER IN A SHEEET FED OFFSET PRINTING MACHINE

[75] Inventors: Peter Hummel, Offenbach; Robert Ortner, Alzenau; Helmut Schild, Steinbach/Ts, all of Germany

[73] Assignee: Man Roland Druckmaschinen AG, Germany

[21] Appl. No.: 629,151

[22] Filed: Apr. 8, 1996

[30] Foreign Application Priority Data

Apr. 8, 1995 [DE] Germany ..... 195 13 378.1

[51] Int. Cl.[6] ..... B41F 7/02

[52] U.S. Cl. ..... 101/218; 101/247; 101/483

[58] Field of Search ..... 101/247, 216, 101/218, 137, 483

[56] References Cited

U.S. PATENT DOCUMENTS

| | | | |
|---|---|---|---|
| 3,800,698 | 4/1974 | Kist et al. | 101/247 |
| 4,000,692 | 1/1977 | Wirz et al. | 101/218 |
| 4,362,098 | 12/1982 | Stelling, Jr. et al. | 101/219 |
| 5,094,162 | 3/1992 | Tafel et al. | 101/218 |
| 5,167,187 | 12/1992 | Dettinger et al. . | |
| 5,186,103 | 2/1993 | Gelinas et al. | 101/247 |
| 5,235,910 | 8/1993 | Taffez | 101/218 |
| 5,265,529 | 11/1993 | Tafel | 101/218 |
| 5,272,975 | 12/1993 | Dettinger et al. . | |

FOREIGN PATENT DOCUMENTS

| | | |
|---|---|---|
| 4013075C1 | 6/1991 | Germany . |
| 4142755A1 | 6/1993 | Germany . |
| 4206626A1 | 9/1993 | Germany . |
| 2084514 | 4/1982 | United Kingdom . |
| 2264673 | 3/1992 | United Kingdom . |

*Primary Examiner*—Eugene H. Eickholt
*Attorney, Agent, or Firm*—Leydig, Voit & Mayer, Ltd.

[57] ABSTRACT

An apparatus for the print throw-on and throw-off of the rubber blanket cylinder in the printing unit of a sheet-fed offset printing machine is described. For the throw-on and throw-off of the rubber blanket cylinder in relation to the impression cylinder and to the plate cylinder, the rubber blanket cylinder is mounted pivotably on both sides in eccentric bearings. The pivoting of the eccentric bearings takes place via two individually switchable actuating means, a print regulation mechanism being connected in series up from the actuating means. The two actuating means act on the eccentric bearings via a ternary member for the pivoting of the eccentric bearings, this arrangement selected in this way making it possible, in the case of larger thicknesses of printing material, to throw off the rubber blanket cylinder only from the plate cylinder. The print throw-off and throw-on thus causes lower torque jolts because of the smaller pivoting travel.

9 Claims, 7 Drawing Sheets

APPARATUS AND PROCESS FOR THE PRINT-ON AND PRINT-OFF SETTING OF A BLANKET CYLINDER IN A SHEEET FED OFFSET PRINTING MACHINE

BACKGROUND OF THE INVENTION

1. Field of the Invention

The present invention relates to an apparatus for the print throw-on and throw-off of the blanket cylinder in the printing unit of a sheet fed offset printing machine and a method for controlling the operation of the apparatus.

2. Discussion of the Related Art

In sheet-fed offset printing machines, it is known to mount the rubber blanket cylinder on two journals, each having eccentric bearings pivotable in the walls of the frame of the printing machine. As a result of the pivoting of the eccentric bearings, the rubber blanket cylinder can be thrown off from the sheet-guiding impression cylinder. In addition, as a result of a further pivoting movement of the eccentric bearings, a throw-off of the rubber blanket cylinder from the plate cylinder carrying the printing form takes place. For the print throw-on, the above described operation is executed in reverse order, that is to say, as a result of a first pivoting movement the rubber blanket cylinder is thrown onto the plate cylinder and then as a result of a second pivoting movement, the rubber blanket cylinder is thrown onto the impression cylinder. As a rule, the throw-on and throw-off of the rubber blanket cylinder takes place during channel correspondence, that is to say, when the channel of the rubber blanket cylinder is opposite the channel of the impression or plate cylinder.

In order to initiate the above described pivoting movements of the eccentric bearings of a rubber blanket cylinder, particularly in the case of high speed sheet-fed offset printing machines, it is known to use actuating means capable of being loaded with pressure medium, for example, pneumatic devices. DE 4,013,075 C1 discloses a print throw-on and throw-off apparatus of this type, in which the piston rods of two pneumatic cylinders are articulated on a toggle mechanism via a ternary member and the toggle mechanism acts on a move-off shaft extending between the side walls of the frame of the printing machine. The pivoting of the two eccentric bearings takes place in each case via levers attached to one end of the move-off shaft, with a link being interposed in each case. The counterbearing of the toggle is adjustable for the purpose of print regulation which is dependent on the thickness of the printing material. On account of the characteristic of the toggle mechanism in conjunction with the articulation of the pneumatic cylinders, it is necessary to activate both cylinders, that is to say initiate the entire pivoting travel of the eccentric bearings, in order to throw off the rubber blanket cylinder from the plate cylinder.

A further print throw-on and print throw-off apparatus, which uses actuating means capable of being loaded by pressure medium is disclosed in DE 4,142,755 A1. In this apparatus, there is provided a coupling of the rubber blanket cylinder and plate cylinder mounting dependent on the thickness of the printing material. In this apparatus, a variation in the setting of the thickness of the printing material causes no variation in the setting between the plate cylinder and the rubber blanket cylinder (printing with and without bearer-ring contact). However, a disadvantage associated with this apparatus is its relatively complicated construction.

In very high-speed sheet-fed offset printing machines (15,000 prints per hour or more), it is the throw-off movements described above which have to be executed in the shortest possible time by pivoting of the eccentric bearings.

However, the pivoting movement of the eccentric bearings gives rise to a torque jolt which is transmitted via the gear train to the remaining printing units. If, for example, the print is thrown off in the first printing unit, this torque jolt generates a disturbance in the subsequent printing units, so that, as a result of mackling caused by the jolt, e.g., blurring or double impression, the sheets printed there are poor quality prints that have to be discarded. A similar effect occurs during the print throw-on, since in this case, for example, during the throw-on of the last printing unit, the disturbance caused thereby likewise causes mackling in the preceding printing units which are already thrown on.

To solve the above described problem, it has been proposed in DE 4,206,626 A1 and DE 4,206,627 A1, to execute the throw-on and throw-off of the rubber blanket cylinder in a manner uncoupled, i.e., essentially reactionlessly, from the drive of the machine. However, the manner in which this operation is to be achieved is not specified in these publications.

SUMMARY OF THE INVENTION

In accordance with one aspect, the present invention is directed to an apparatus for the print throw-on and throw-off of a rubber blanket cylinder in a printing unit of a sheet-fed offset printing machine. The apparatus comprises first and second setting means, a first ternary member, and a print regulation mechanism. The first and second setting means are independently actuable for pivoting eccentric bearings operatively associated with the rubber blanket cylinder. The first and second setting means are coupled to the eccentric bearings via the first ternary member and at least one lever. The print regulation mechanism is serially connected to the first setting means for adjusting the axial spacing of the rubber blanket cylinder with respect to an impression cylinder of the printing machine in accordance with the thickness of printing material.

In accordance with another aspect, the present invention is directed to a method for switching of a rubber blanket cylinder in a printing unit of a sheet-fed offset printing machine. The method comprises throwing-on and throwing-off the rubber blanket with respect to an impression cylinder and a plate cylinder through independently actuable setting means, adjusting the axial spacing of the rubber blanket cylinder with respect to the impression cylinder in accordance with printing material thickness, and actuating only one of the independently actuable setting means which controls the throw-on and throw-off of the rubber blanket cylinder with respect to the plate cylinder when the printing material is above a predetermined thickness.

The apparatus and method of the present invention function to reduce the torsional shocks arising in the switching of the throwing-on and throwing-off of the rubber blanket cylinder thereby reducing waste by preventing poor quality prints.

As a result of the articulation, provided according to the present invention, of the actuators capable of being loaded with pressure medium, e.g., air, in conjunction with the series connection between the setting of the thickness of the printing material and the actuator for throwing the rubber blanket cylinder on and off from the impression cylinder, it is possible, beyond a particular thickness of printing material, for example 0.5 mm, no longer to throw off the rubber blanket cylinder from the impression cylinder, but not only from the plate cylinder. Since, as a rule, there is a regulation of approximately 0.2 mm between the rubber blanket and impression cylinders, a larger thickness of printing material means that, when the impression cylinder is not guiding a sheet, the rubber blanket cylinder has no contact at all with the surface of the impression cylinder.

According to a development of the present invention, there is provision, particularly via the machine control stand, for the possibility of entering the thickness of printing material for remote adjustment in the individual printing units and, depending on the entered value of the thickness of printing material, for the associated control to initiate the throw-on and throw-off of the rubber blanket cylinder selectively from the impression and plate cylinders or only from the plate cylinder.

BRIEF DESCRIPTION OF THE DRAWINGS

Exemplary embodiments of the apparatus for print throw-on and throw-off in accordance with the present invention is described below with reference to the accompanying drawings in which.

DETAILED DESCRIPTION OF THE PREFERRED EMBODIMENTS

In typical offset printing machines, sheets to be printed are transported from a feed table to a delivery stack and then fed into the printing unit of the printing machine. In order to define the printed matter, the printing machine includes a printing plate mounted on a plate cylinder and ink is applied to the printing plate via an inking unit. The printing plate, however, does not directly contact the sheets fed through the printing machine; rather, the ink from the printing plate is transferred to a rubber blanket mounted on a blanket cylinder. In order to aid the transfer of ink from the printing plate to the rubber blanket, the printing plate is dampened by dampening fluid from a damping unit. To produce a print on the fed sheets, the fed sheets are conveyed over an impression cylinder which cooperates with the blanket cylinder.

Figure 1:
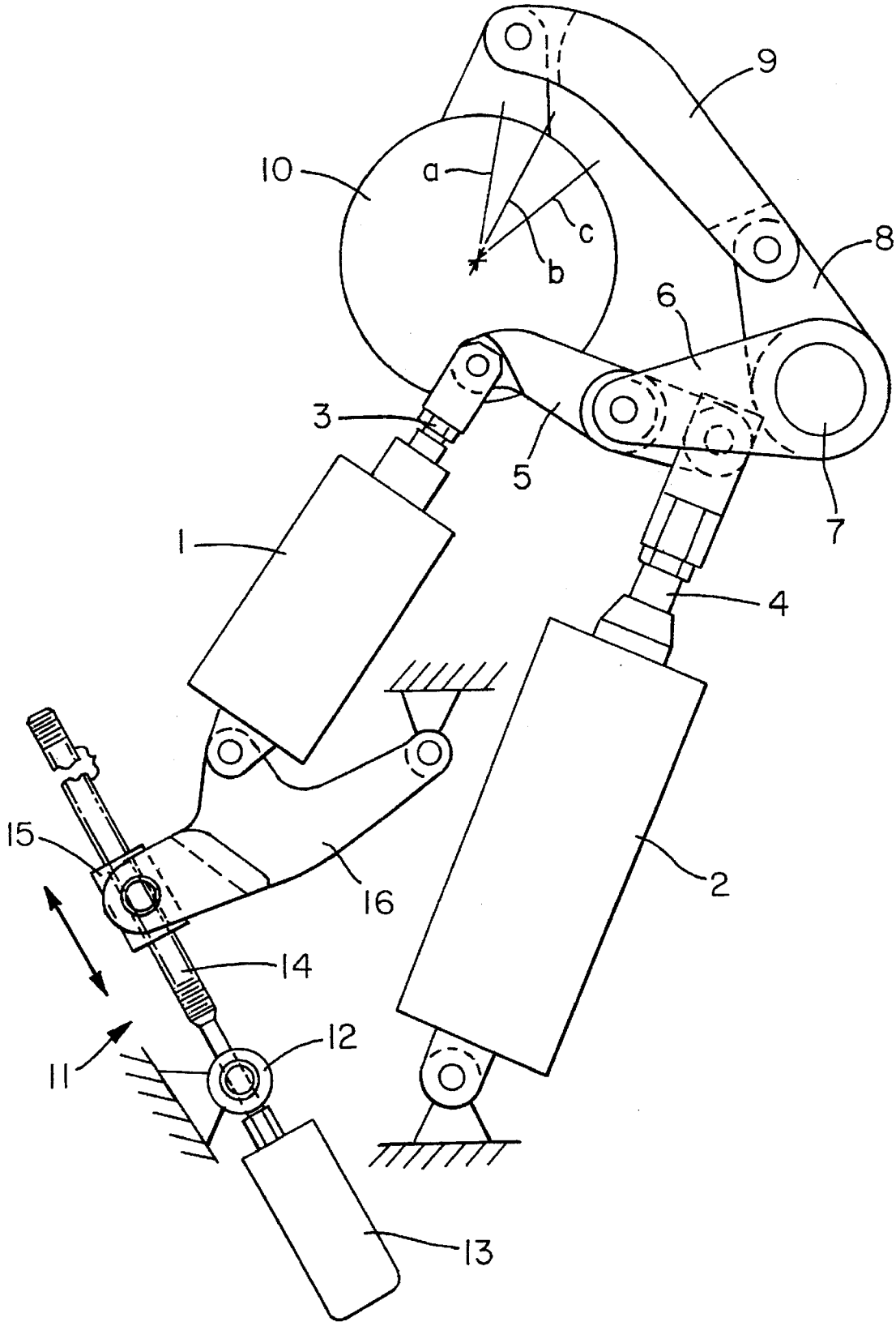
FIG. 1 illustrates the arrangement of the two actuating means in conjunction with the setting of the thickness of the printing material.

FIG. 1 illustrates an arrangement of the print throw-on and throw-off apparatus according to the present invention. The print throw-on and throw-off apparatus comprises two actuating means 1,2 which are arranged next to one another. In the exemplary embodiment, the two actuating means comprise double-acting pneumatic cylinders which include piston rods 3,4. The piston rods 3,4 are articulated on a first ternary member 5 designed as a link. The second actuating means 2 is fixedly mounted on its base frame, whereas the first actuating means 1 is articulated on a second ternary member 16, the function of which is explained in detail below.

The link-like first ternary member 5 is articulated on the pivotable end of a first lever 6 attached to a move-off shaft 7. The move-off shaft 7 extends between the two frame walls of the printing unit which are not illustrated in FIG. 1. Attached to each of the two ends of the move-off shaft 7 projecting from the side frame walls is a second lever 8. Each of the second levers 8 is connected via a link 9, to eccentric bearings 10 mounted pivotably in the side frame walls of the printing unit and carrying the rubber blanket cylinder via its journals. In FIG. 1, the three possible pivoting positions of the eccentric bearings 10 are denoted by a, b, and c. In the representation according to FIG. 1, the eccentric bearings 10 are in the position denoted by a, which correspond to the print-on state, in which the rubber blanket cylinder is thrown both onto the impression cylinder and onto the plate cylinder. As a result of the pivoting of the eccentric bearings 10 into the position b, as explained below, the rubber blanket cylinder is thrown off from the impression cylinder, the rubber blanket cylinder remaining, as before, in contact with the plate cylinder. A further pivoting movement from position b into position c then brings about the throw-off of the rubber blanket cylinder from the plate cylinder.

The foot of the first actuating means 1 is articulated approximately centrally on the second ternary member 16, the latter being fixed to the frame of the printing unit by means of a second point of articulation and being articulated on a nut 15, screwed on a threaded spindle 14, by means of a third point of articulation. Furthermore, the threaded spindle 14 is guided through a rotary joint 12, the latter being arranged fixedly relative to the frame of the printing unit. Attached to that side of the rotary joint 12 facing away from the threaded spindle 14 is a motor 13, by means of which the threaded spindle 14 can be driven in both directions of rotation. The previously described components, comprising the rotary joint 12, of the motor 13, the threaded spindle 14, and the second ternary member 16 articulated thereon via the nut 15 form the print regulation mechanism 11, by means of which the rubber blanket cylinder can be thrown onto the impression cylinder according to the thickness of the printing material in a remotely adjustable manner.

Figure 2:
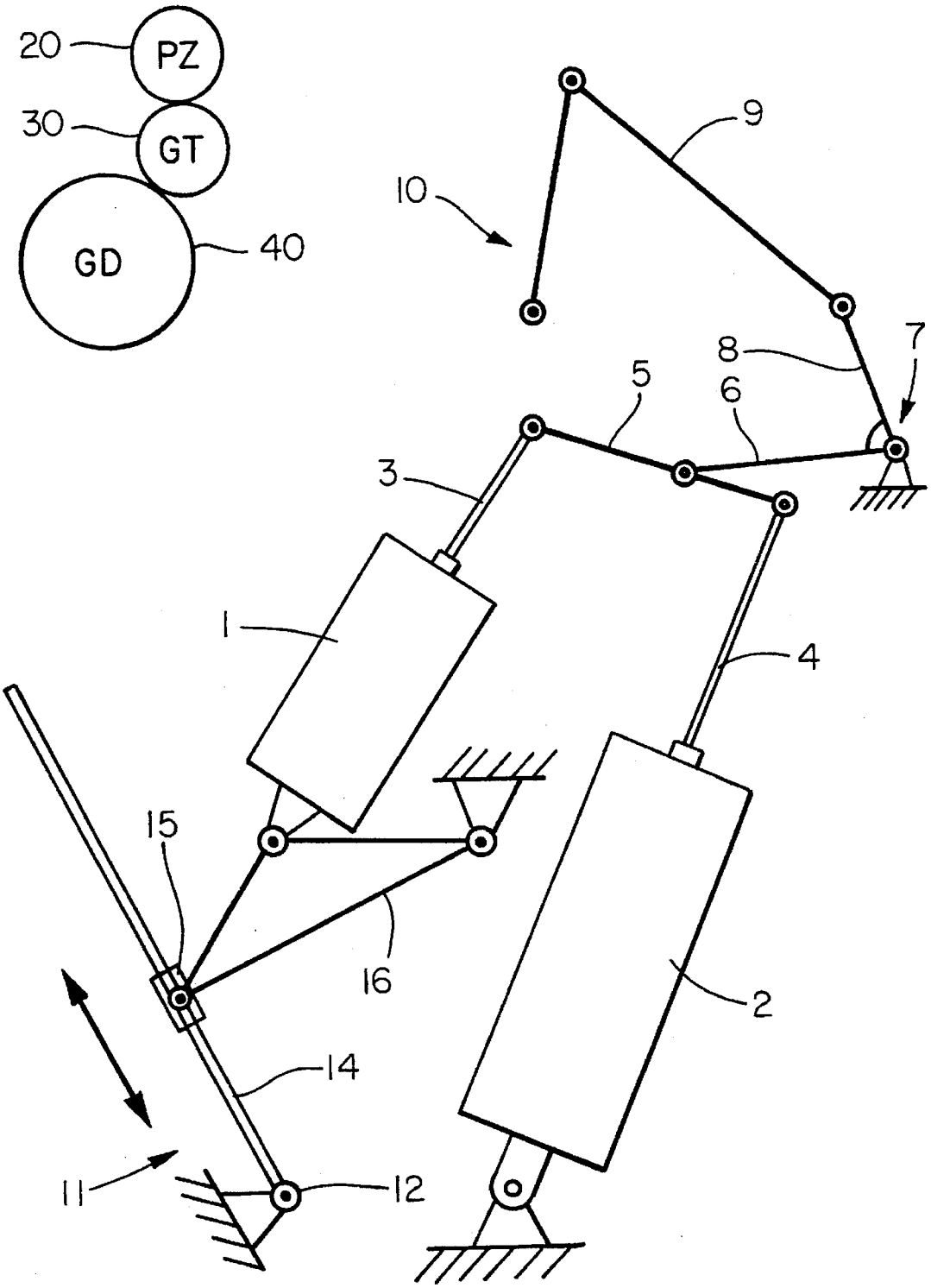
FIGS. 2 to 6 illustrate the various positions of the apparatus according to FIG. 1 during the throw-on and throw-off operations.

FIG. 2 illustrates, in diagrammatic form, the arrangement of the first and second actuating means 1,2 of FIG. 1 and the plate cylinder 20, rubber blanket cylinder 30, and impression cylinder 40. In this case, the retracted piston rods 3,4 of the actuating means 1,2 ensure, via the first ternary member 5, the first lever 6, the move-off shaft 7, the second levers 8 attached to the move-off shaft 7 on both sides thereof, the link 9 and the eccentric bearings 10, that the rubber blanket cylinder 30 is thrown both onto the impression cylinder 40 and onto the plate cylinder 20. FIGS. 2 to 6 reproduce in diagrammatic form, the positions of the rubber blanket cylinder 30 in relation to the impression cylinder 40 and to the plate cylinder 20. Furthermore, it may be assumed in the descriptions of FIGS. 2 to 4 that a thin printing material is being printed, so that the print regulation mechanism 11 is set at a low value, the nut 15 seated on the threaded spindle 14 thus holding the first actuating means 1 in a lower position via the second ternary member 16.

Figure 3:
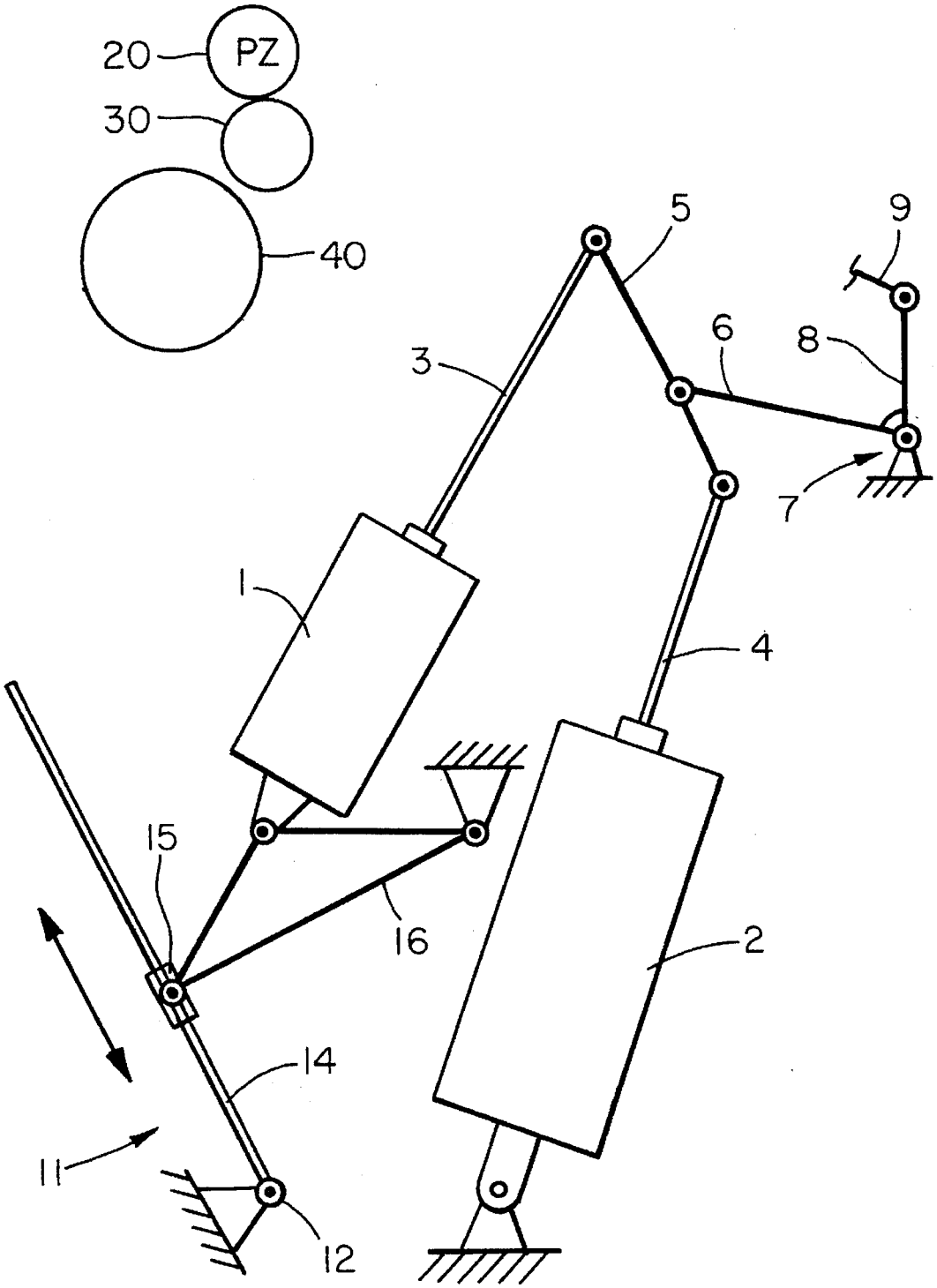

When, after the printing of a last sheet, the rubber blanket cylinder 30 is to be thrown off from the impression cylinder 40, if thin printing materials are being printed, the first actuating means 1 is activated, while there is channel correspondence between the rubber blanket cylinder 30 and the impression cylinder 40, by loading the working cylinder of the first actuating means 1 with compressed air, so that the piston rod 3 extends from the first actuating means 1. FIG. 3 reproduces, likewise in diagrammatic form, the state in which the piston rod 3 is extended from the first actuating means 1. At the same time, via the link-like first ternary member 5, the first lever 6 has been pivoted from the position according to FIG. 2 into the position according to FIG. 3, so that the move-off shaft 7 and the second levers 8 attached on both sides have likewise been pivoted through a specific angular distance. Via the link 9 represented only partially in FIG. 3, the eccentric bearings 10 according to FIG. 1 have been pivoted from position a into the position b, so that, as reproduced at the top in FIG. 3, the rubber blanket cylinder 30 no longer has any contact with the impression cylinder 40.

Figure 4:
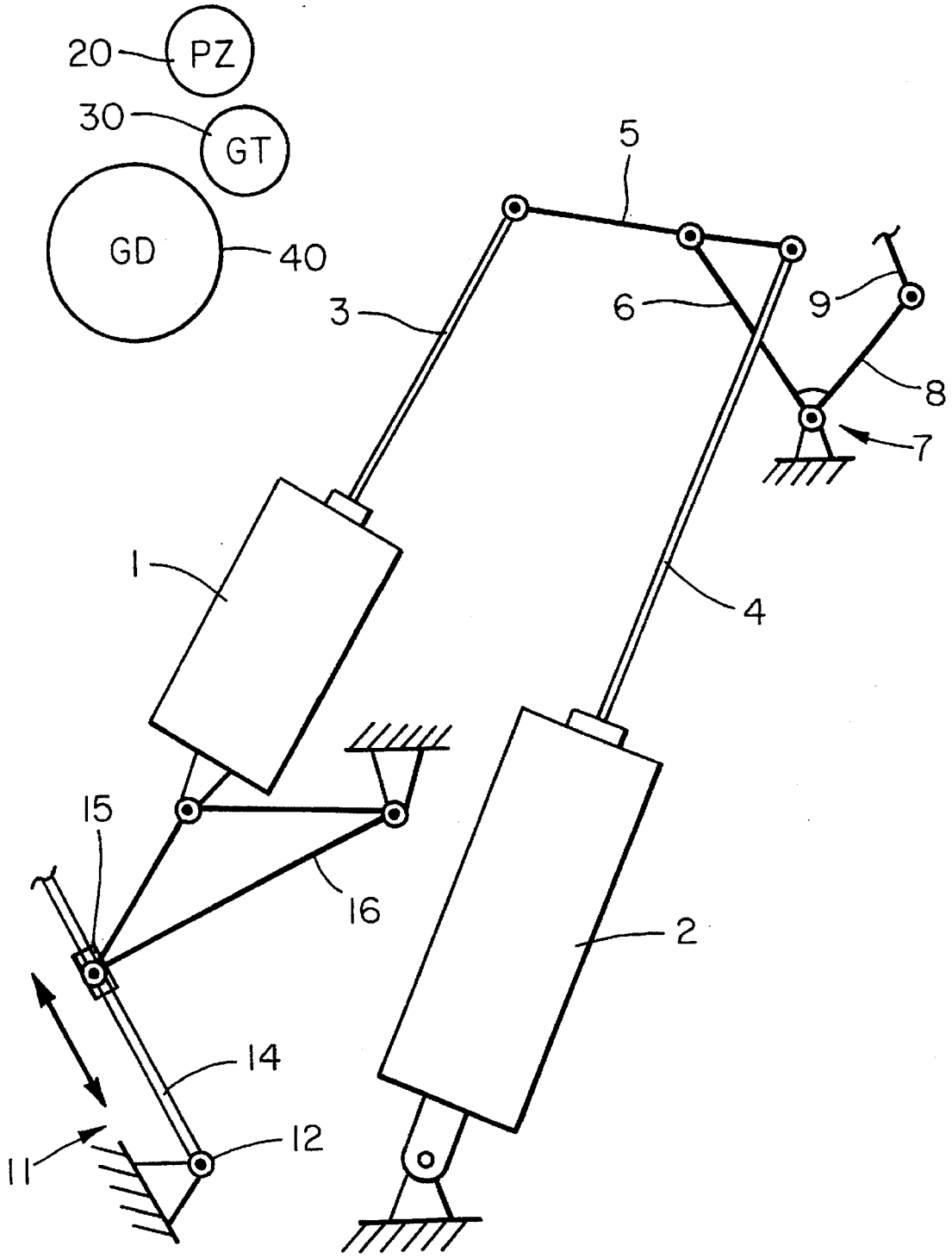

Now if, starting from the position according to FIG. 3, the rubber blanket cylinder 30 is to also be thrown off from the plate cylinder 20, then activation of the second actuating means 2 takes place by loading the corresponding working cylinder of the second actuating means 2 with compressed air, so that the piston rod 4 of the second actuating means 2 passes from the retracted position into the extended position (FIG. 4). Via the link-like first ternary member 5, a pivoting of the first ternary member 5 then takes place about the point of articulation of the piston rod 3, so that, starting from the position according to FIG. 3, the first lever 6 connected to the move-off shaft 7 is pivoted through a further angular distance into the position according to FIG. 4. Via the second levers 8 attached to the move-off shaft 7 on both sides and via the links 9, a pivoting of the eccentric bearings 10 represented in FIG. 1 from position b to position c thereby takes place. The rubber blanket cylinder 30 is then thrown off both from the impression cylinder 40 and from the plate cylinder 20.

For print throw-on, starting from a position of the rubber blanket cylinder 30 according to FIG. 4, the operation takes place in reverse order to the procedure previously described. In the first place, therefore, as a result of the activation of the second actuating means 2 its piston rod 4 is retracted out of the position according to FIG. 4, whereupon the throw of the rubber blanket cylinder 30 onto the plate cylinder 20 takes place. After a selectable number of revolutions of the rubber blanket cylinder 30, the switching of the first actuating means 1 then occurs, so that the piston rod 3 passes out of the position illustrated in FIG. 3 into the retracted position according to FIG. 2 or FIG. 1.

Figure 5:
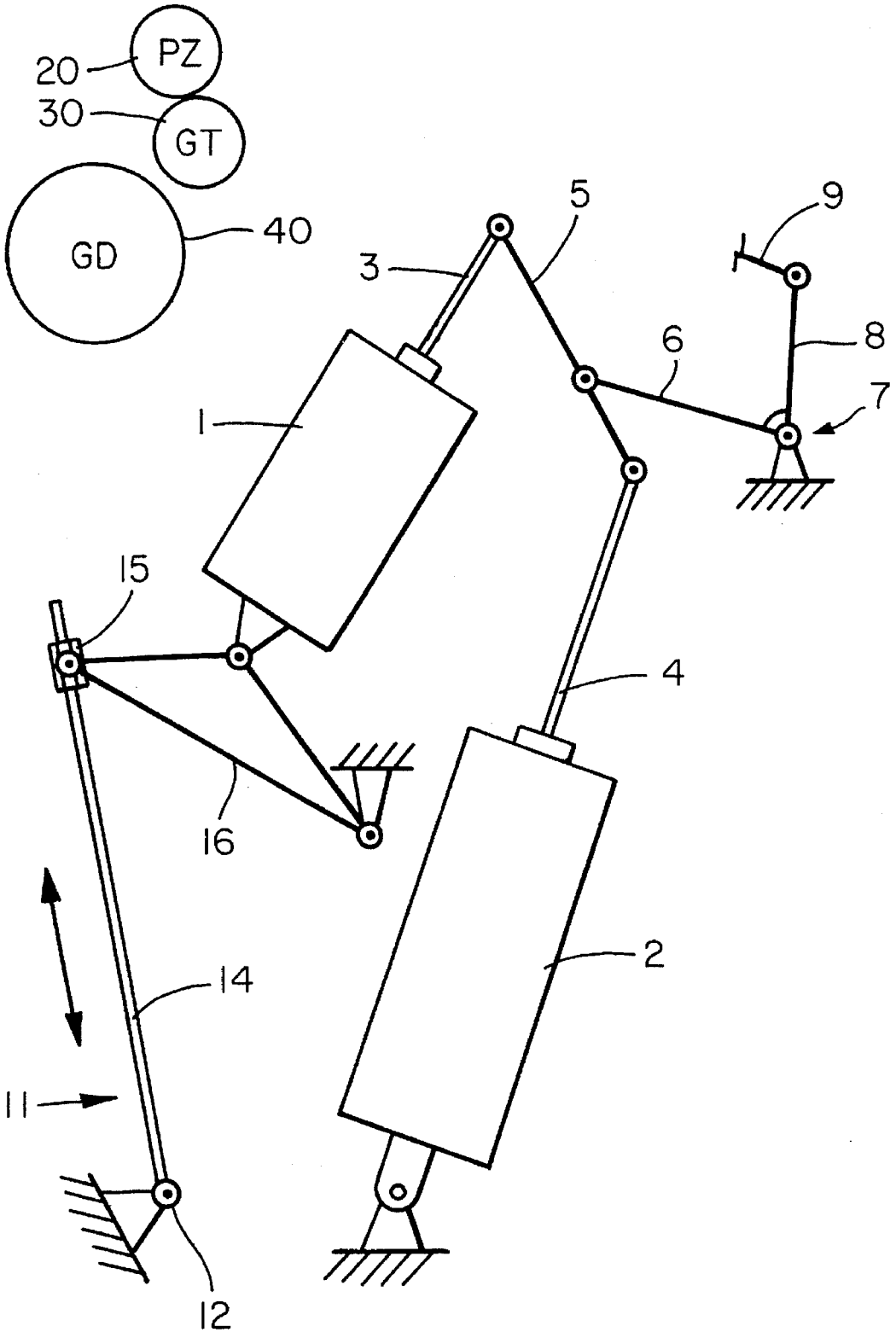
Figure 6:
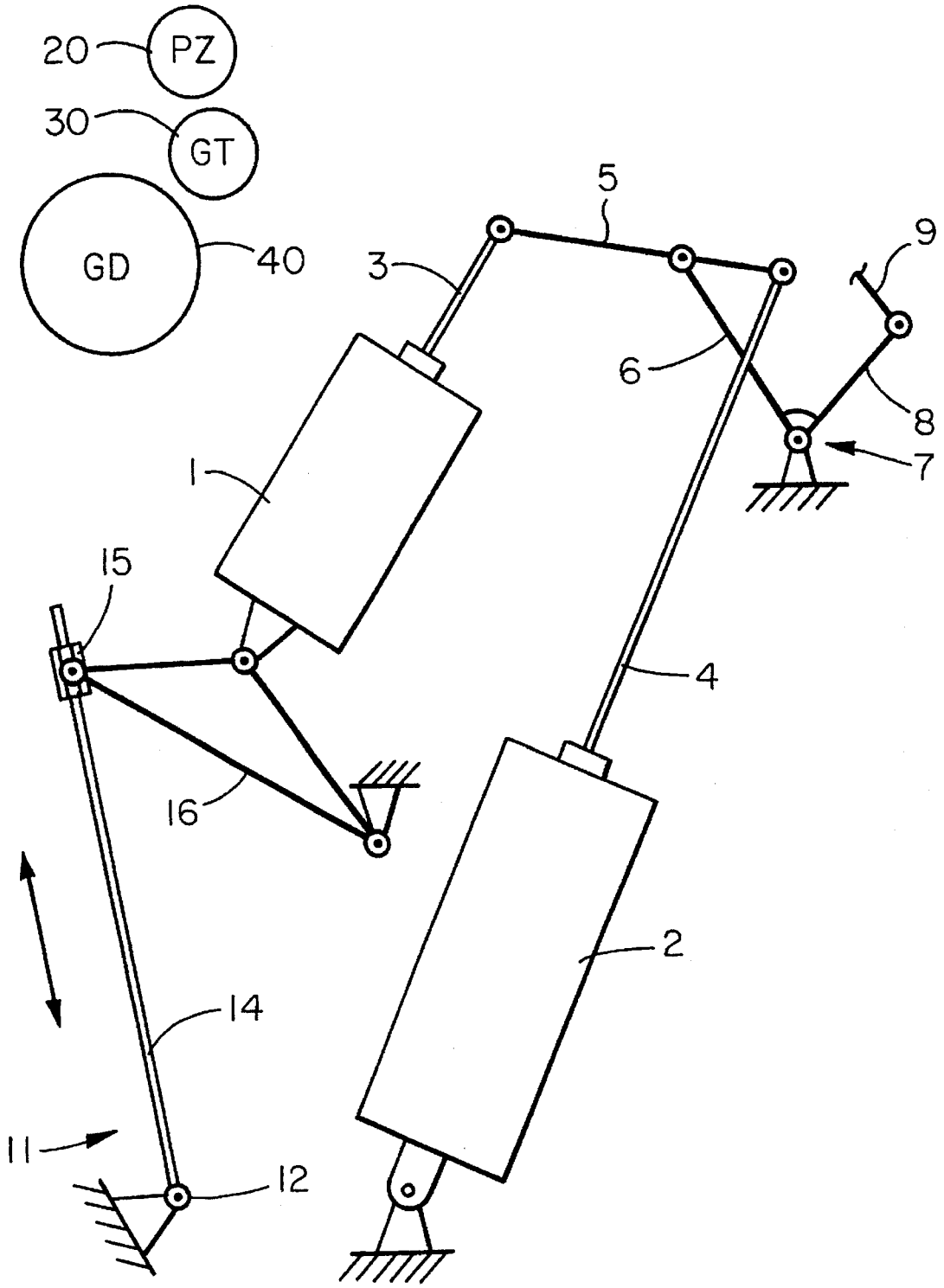

An explanation of the print throw-on and print throw-off in which thick printing materials are printed is now given with reference to FIG. 5 and 6. By driving the motor 13 not shown in FIGS. 2 to 6, the print regulation mechanism 11 has been moved via the threaded spindle 14 into a position corresponding to the thickness of the printing material. Via the second ternary member 16 articulated fixedly relative to the frame of the printing unit, on the one hand, and, furthermore, connected to the foot of the first actuating means 1, the first actuating means 1 and the piston rod 3 located in the bottom dead center position have been moved forward until the first ternary member 5 in FIG. 5 assumes approximately the same position as in FIG. 3, in the case described there the piston rod 3 being in its extended, that is to say the top dead center position. When printing material thicker than, for example, 0.5 mm is being printed, there is no throw-off of the rubber blanket cylinder 30 from the impression cylinder 40 on account of the correspondingly set print regulation mechanism 11. Since the first actuating means 1 is connected in series down from the print regulation mechanism 11, the previously described arrangement ensures that, beyond a specific thickness of printing material, the rubber blanket cylinder 30 no longer has any contact at all with the surface of the impression cylinder 40. In the absence of a sheet, therefore, the throw-off of the rubber blanket cylinder 30 from the impression cylinder 40 can be dispensed with. It may be noted, at this juncture, that in the case of larger thicknesses of printing material, the eccentric bearings 10 according to FIG. 1 have been pivoted approximately into a position according to b on account of the series connection of the first actuating means 1 and the print regulation mechanism 11. In this case, position a of the eccentric bearings 10 corresponds to the print regulation in the case of a thickness of printing material of 0.0 mm.

To throw off the rubber blanket cylinder 30 from the plate cylinder 20, the extension of the piston rod 4 of the second actuating means 2 then takes place, starting from the position according to FIG. 5, so that, as shown in FIG. 6, a pivoting of the first lever 6 and of the move-off shaft 7 via the first ternary member 5 supported on the end of the piston rod 3 occurs. A pivoting of the eccentric bearings 10 represented in FIG. 1 then likewise takes place out of a position, which corresponds approximately to the position denoted by b, into the end position c (FIG. 1).

For print throw-on, in the case of large thicknesses of printing material, starting from the position according to FIG. 6, after a predetermined number of revolutions of the rubber blanket cylinder 30, the rubber blanket cylinder 30 is thrown onto the plate cylinder 20 again by switching the second actuating means 2. As a result of the retraction of the piston rod 4 of the second actuating means 2 from the top dead center to the bottom dead center position, the eccentric bearings 10 according to FIG. 1 are pivoted from the end position c into a position which depends on the set thickness of printing material and which corresponds approximately to the position denoted by b.

The print throw-on and throw-off of the rubber blanket cylinder 30 in relation to the plate cylinder 20, which is single-stage in the case of thicker printing materials, ensures that smaller pivoting travel of the eccentric bearings 10 (FIG. 1) has to be executed in comparison with the two-stage print switching. As a result of this small pivoting travel which, according to FIG. 1 and the statements made above, corresponds approximately to the angle b-c, a substantially lower torque jolt is introduced into the drive train of the printing units. Since it is precisely the print throw-off, initiated by incorrectly fed sheets, which takes place at high printing speeds, the sheets still located in the machine and still to be printed are prevented from becoming ruined as a result of mackling caused by torque jolts. Since a certain number of ruined sheets becomes costly, which is especially true in the case of thick printing materials, a particular advantage of the print switching according to the invention is recognized.

Figure 7:
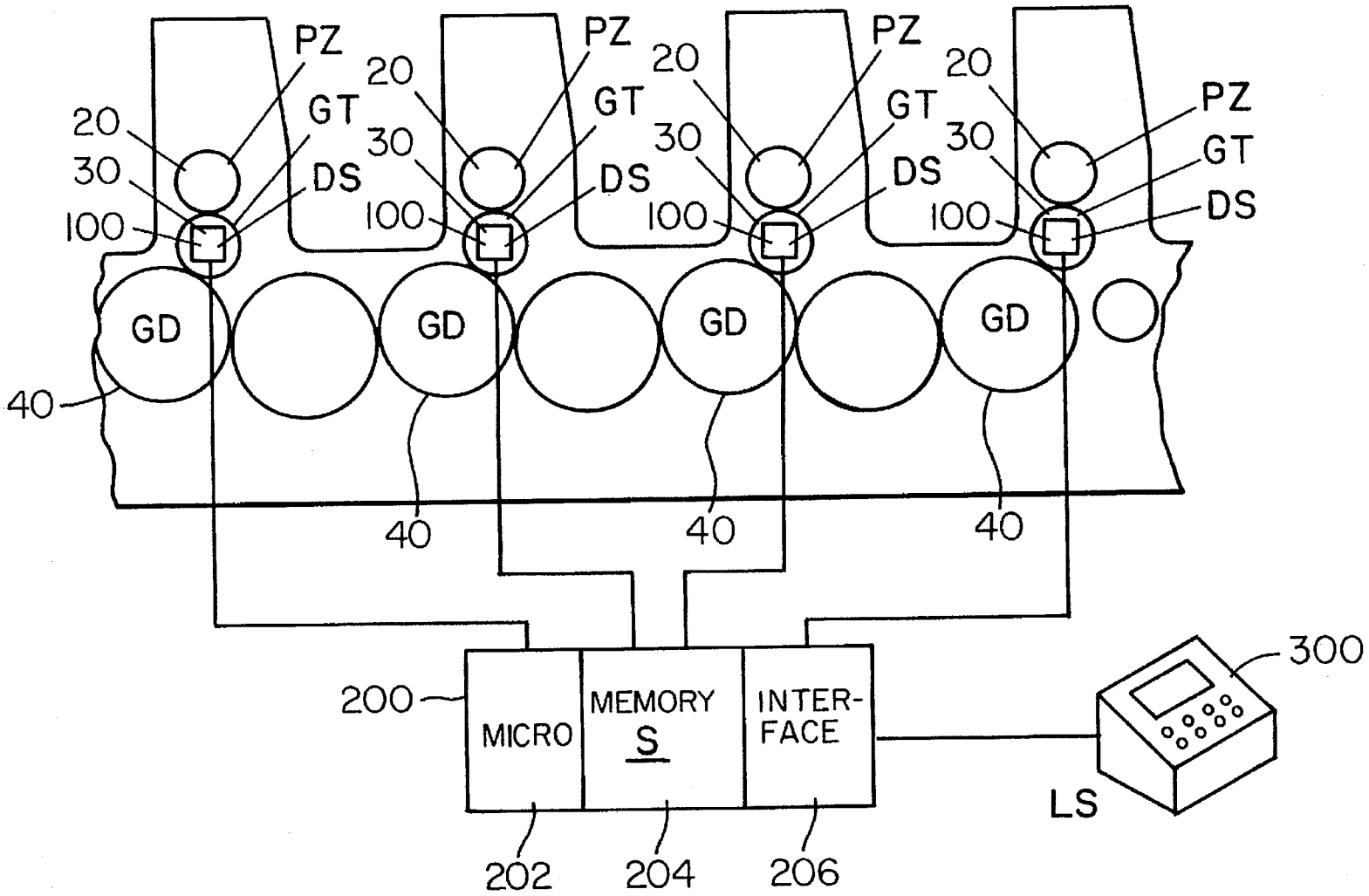
FIG. 7 illustrates a controller assigned to the printing units of a sheet-fed offset printing machine.

A description of the use of the print throw-on and throw-off according to the invention is also given with reference to FIG. 7. This represents the first four printing units of a sheet-fed offset printing machine with the plate cylinders 20, the rubber blanket cylinders 30, and the impression cylinders 40 arranged underneath them. Assigned purely symbolically to the individual rubber blanket cylinders 30 are print switching devices 100 which contain the components illustrated in FIG. 1. These are here, in particular, the print regulation mechanism 11 and the two actuating means 1 and 2 capable of being loaded with compressed air. The print switching device 100 can be activated remotely from a control system 200, the motors 13 of the print regulation mechanism 11 being movable correspondingly via a thickness of printing material entered on the control stand 300 of the printing machine. The first and second actuating means 1 and 2 designed as double-acting pneumatic cylinders can be switched from the control system 200 via electromagnetically actuatable valves not shown in FIGS. 1–6.

Furthermore, the control system 200 is operatively connected to sheet-monitoring means (not shown) on the equipment of the printing machine, in order to throw off the print in the individual printing units consistently after an incorrect sheet or a missing sheet has been detected. Likewise, a consistent print throw-on is initiated by the control system 200 after a first sheet has run in.

The control system 200 implements the above described throw-on and throw-off process. The control system 200 may comprise a hardware controller, a software controller, or a combination hardware/software controller. In a preferred embodiment, the control system 200 comprises a hardware/software controller. The exemplary control system 200 comprises a microprocessor 202, a memory 204, and interface circuitry 206. The memory 204 includes the software to implement the above-described process. The interface circuitry 206 includes all the circuits for the communication of information and commands between the control system 200 and the switching devices 100 to which the control system 200 is connected. For example, the interface circuitry 206 may comprise analog to digital converters and digital to analog converters. Commands may be input to the control system 200 and information received therefrom by the control stand 300 which may comprise a display and keyboard.

Provision is made, according to the invention, for the rubber blanket cylinders 30 to be thrown off only from the plate cylinder 20 for print throw-off in the case of thicknesses of printing material which are above a predetermined value. The same applies to the throw-on of the print during restarting after a stop. In the case of thicknesses of printing material which have been entered via the control stand 300 and which are below a predetermined value, the customary two-stage print throw-off and throw-on takes place, that is to say the rubber blanket cylinder 30 is first thrown off from the impression cylinder 40 and then from the plate cylinder 20 and is thrown onto these cylinders again in corresponding reverse order. The predetermined threshold value, above which a changeover is made between single-stage and two-stage print throw-on and print throw-off, can, for example, be 0.5 mm.

According to one aspect of the present invention, beyond a thickness of printing material of, for example, 0.5 mm, print throw-off takes place only when the last sheet has passed the last printing unit. The separation of the inking unit and the throw-off of the ink applicator rollers then take place, in order to prevent the overinking of the plate cylinder. During throw-on, throw-on takes place on all the units simultaneously before the first sheet runs into the first printing unit.

Although shown and described are what is believed to be the most practical and preferred embodiments, it is apparent that departures from specific methods and designs described and shown will suggest themselves to those skilled in the art and may be used without departing from the spirit and scope of the invention.

The present invention is not restricted to the particular constructions described and illustrated, but should be construed to cohere with all modifications that may fall within the scope of the appended claims.

What is claimed is:

1. An apparatus for the print throw-on and throw-off of a rubber blanket cylinder in a printing unit of a sheet-fed offset printing machine comprising:

first and second setting means for pivoting eccentric bearings operatively associated with the rubber blanket cylinder, the first and second setting means being individually actuable;

a first ternary member coupling the first and second setting means to the eccentric bearings through at least one lever; and a print regulation mechanism serially connected to the first setting means for adjusting the axial spacing of the rubber blanket cylinder with respect to an impression cylinder of the printing machine in accordance with the thickness of printing material, the print regulation mechanism comprising:

a screw mechanism having a threaded spindle and a nut;

a second ternary member coupled to the first setting means, a fixed point of the printing unit, and to the screw mechanism; and a rotary joint coupled to the screw mechanism.

2. The apparatus according to claim 1, wherein the threaded spindle is coupled to and is driven by a motor via the rotary joint.

3. The apparatus according to claim 2, wherein the first and second setting means each comprise double-acting pneumatic cylinders.

4. The apparatus according to claim 1, further comprising a controller coupled to the first and second setting means for actuating the first and second setting means to throw-on and throw-off the rubber blanket cylinder in relation to the impression cylinder when the thickness of the printing material is below a predetermined value.

5. A method for the switching of a rubber blanket cylinder in a printing unit of a sheet-fed offset printing machine, the method comprising the steps of:

throwing-on and throwing-off the rubber blanket cylinder with respect to an impression cylinder and a plate cylinder through independently actuable setting meanS;

adjusting the axial spacing of the rubber blanket cylinder with respect to the impression cylinder in accordance with printing material thickness; and actuating only one of the independently actuable setting means which controls the throw-on and throw-off of the rubber blanket cylinder with respect to the plate cylinder when the printing material is above a predetermined thickness.

6. An apparatus for the print throw-on and throw-off of a rubber blanket cylinder in a printing unit of a sheet-fed offset printing machine comprising:

first and second setting means for pivoting eccentric bearings operatively associated with the rubber blanket cylinder, the first and second setting means being individually actuable;

a first ternary member coupling the first and second setting means to the eccentric bearings through at least one lever;

a print regulation mechanism serially connected to the first setting means for adjusting the axial spacing of the rubber blanket cylinder with respect to an impression cylinder of the printing machine in accordance with the thickness of printing material; and a controller coupled to the first and second setting means for actuating the first and second setting means to throw-on and throw-off the rubber blanket cylinder in relation to the impression cylinder when the thickness of the printing material is below a predetermined value.

7. The apparatus according to claim 6, wherein the print regulation mechanism comprises:

a screw mechanism having a threaded spindle and a nut;

a second ternary member coupled to the first setting means, a fixed point of the printing unit, and to the screw mechanism; and a rotary joint coupled to the screw mechanism.

8. The apparatus according to claim 7, wherein the threaded spindle is coupled to and is driven by a motor via the rotary joint.

9. The apparatus according to claim 8, wherein the first and second setting means each comprise double-acting pneumatic cylinders.

* * * * *